US008479711B2

(12) United States Patent
Morris et al.

(10) Patent No.: US 8,479,711 B2
(45) **Date of Patent: *Jul. 9, 2013**

(54) PIEZOELECTRIC DIRECT ACTING FUEL INJECTOR WITH HYDRAULIC LINK

(75) Inventors: Corydon E. Morris, Columbus, IN (US); Bela Doszpoly, Columbus, IN (US)

(73) Assignee: Cummins Intellectual Propeties, Inc., Minneapolis, MN (US)

( * ) Notice: Subject to any disclaimer, the term of this patent is extended or adjusted under 35 U.S.C. 154(b) by 509 days.

This patent is subject to a terminal disclaimer.

(21) Appl. No.: 12/797,161

(22) Filed: Jun. 9, 2010

(65) Prior Publication Data

US 2010/0313853 A1 Dec. 16, 2010

Related U.S. Application Data

(60) Provisional application No. 61/185,779, filed on Jun. 10, 2009.

(51) Int. Cl.
*F02M 51/06* (2006.01)

(52) U.S. Cl.
USPC ..... 123/490; 123/494; 123/498

(58) Field of Classification Search
USPC ..... 123/472, 490, 494, 498; 239/585.1; 251/129.01, 129.15
See application file for complete search history.

(56) References Cited

U.S. PATENT DOCUMENTS

| | | | |
|---|---|---|---|
| 3,680,782 | A | 8/1972 | Monpetit et al. |
| 4,545,352 | A | 10/1985 | Jourde et al. |
| 4,728,074 | A | 3/1988 | Igashira et al. |
| 4,782,807 | A | 11/1988 | Takahashi |
| 4,798,186 | A | 1/1989 | Ganser |
| 4,826,080 | A | 5/1989 | Ganser |
| 5,860,597 | A | 1/1999 | Tarr |
| 6,253,736 | B1 | 7/2001 | Crofts et al. |
| 6,298,829 | B1 | 10/2001 | Welch et al. |
| 6,390,385 | B1 | 5/2002 | Hardy et al. |

(Continued)

FOREIGN PATENT DOCUMENTS

| | | | |
|---|---|---|---|
| EP | 09673822001-11-24 | B1 | 11/2004 |
| WO | 02095212 | | 11/2002 |

OTHER PUBLICATIONS

Notification of Transmittal of the International Search Report and the Written Opinion of the International Searching Authority, or the Declaration with mailing date of Feb. 1, 2011; International Application No. PCT/US2010/037949.

*Primary Examiner* — Hai Huynh
(74) *Attorney, Agent, or Firm* — Studebaker & Brackett PC

(57) ABSTRACT

A piezoelectric-actuated fuel injector for injecting fuel into a combustion chamber of an internal combustion engine is provided which includes a piezoelectric actuator movable to expand in a first direction and movable to contract in a second direction opposite the first direction, and a hydraulic link assembly disposed within a nozzle cavity formed in a nozzle housing containing a nozzle valve element. The hydraulic link assembly is positioned close to the injector orifices to minimize needle valve element length and mass, thereby reducing seat impact forces and enhance response time. A refill valve operates to move into an open position to refill a hydraulic link chamber. An actuator power source operates to vary voltage to cause multiple injection pulses and to selectively maintain the voltage above a predetermined lower level between injection pulses to maintain the refill valve in a closed position to prevent refilling of the hydraulic link chamber.

20 Claims, 6 Drawing Sheets

U.S. PATENT DOCUMENTS

| | | | | |
|---|---|---|---|---|
| 6,499,467 | B1 | 12/2002 | Morris et al. | |
| 6,520,423 | B1 | 2/2003 | Ricci-Ottati et al. | |
| 6,550,455 | B2 | 4/2003 | Carroll, III et al. | |
| 6,575,138 | B2 | 6/2003 | Welch et al. | |
| 6,676,030 | B2 | 1/2004 | Lorraine et al. | |
| 6,676,035 | B2 | 1/2004 | Lorraine et al. | |
| 6,739,528 | B2 | 5/2004 | Lorraine et al. | |
| 6,776,354 | B2 | 8/2004 | Cooke | |
| 6,948,667 | B2 | 9/2005 | Eichendorf | |
| 6,978,770 | B2 | 12/2005 | Rauznitz et al. | |
| 7,073,730 | B2 | 7/2006 | Haag et al. | |
| 7,077,115 | B2 | 7/2006 | Weber et al. | |
| 7,140,353 | B1 | 11/2006 | Rauznitz et al. | |
| 7,258,283 | B2 | 8/2007 | Heinz et al. | |
| 7,353,806 | B2 | 4/2008 | Gant | |
| 7,451,938 | B2 | 11/2008 | Cooke | |
| 8,201,543 | B2 * | 6/2012 | Morris et al. | 123/494 |
| 2012/0048239 | A1 * | 3/2012 | Jalal et al. | 123/472 |

* cited by examiner

PIEZOELECTRIC DIRECT ACTING FUEL INJECTOR WITH HYDRAULIC LINK

BACKGROUND

1.Technical Field

The present invention relates generally to fuel injection systems and, more particularly, to a fuel injector and method for improved piezoelectric fuel injection.

2. Description of Related Art

In many fuel supply systems applicable to internal combustion engines, fuel injectors are used to inject fuel pulses into the engine combustion chamber. A commonly used injector is a closed-nozzle injector which includes a nozzle assembly having a spring-biased nozzle valve element positioned adjacent the nozzle orifice for allowing fuel to be injected into the cylinder. The nozzle valve element also functions to provide a deliberate, abrupt end to fuel injection, thereby preventing a secondary injection which causes unburned hydrocarbons in the exhaust. The nozzle valve is positioned in a nozzle cavity and biased by a nozzle spring so that when an actuated force exceeds the biasing force of the nozzle spring, the nozzle valve element moves to allow fuel to pass through the nozzle orifices, thus marking the beginning of the injection event.

Internal combustion engine designers have increasingly come to realize that substantially improved fuel supply systems are required in order to meet the ever increasing governmental and regulatory requirements of emissions abatement and increased fuel economy. As such, one aspect of fuel supply systems that has been the focus of designers is the use of piezoelectric actuators in fuel injectors.

In general, piezoelectric actuators have long been recognized as highly desirable for use in systems requiring extremely fast mechanical operation in response to an electrical control signal. For this reason, piezoelectric actuators have received considerable attention by designers of fuel supply systems for internal combustion engines. Such designers are continually searching for ways to obtain faster, more precise, reliable, and predictable control over the timing and quantity of successive fuel injections into the combustion chambers of internal combustion engines to help meet the economically and governmentally mandated demands for increasing fuel economy and reduced air pollution. If such goals are to be attained, fuel control valves must be designed to provide extremely fast and reliable response times.

SUMMARY OF THE INVENTION

The various advantages of exemplary embodiments may be achieved by providing a piezoelectric-actuated fuel injector for injecting fuel into a combustion chamber of an internal combustion engine, comprising an injector body including a barrel, a nozzle housing having a nozzle cavity, a retainer connecting the barrel and the nozzle housing, and an injector orifice communicating with one end of the nozzle cavity to discharge fuel into the combustion chamber. A nozzle valve element is positioned in the nozzle cavity adjacent the injector orifice and movable between an open position in which fuel flows through the injector orifice into the combustion chamber and a closed position in which fuel flow through the injector orifice is blocked. A piezoelectric actuator is provided which includes a stack of piezoelectric elements movable to expand in a first direction and movable to contract in a second direction opposite the first direction. A hydraulic link assembly is positioned within the nozzle cavity, and includes a hydraulic link housing having an inner bore, a hydraulic link plunger positioned to slidably move in the inner bore and operably connected to the piezoelectric actuator, and a hydraulic link operatively connecting the hydraulic link plunger and the nozzle valve element.

Another exemplary embodiment includes a piezoelectric-actuated fuel injector for injecting fuel into a combustion chamber of an internal combustion engine, comprising an injector body including a nozzle housing having a nozzle cavity, an injector orifice communicating with one end of the nozzle cavity to discharge fuel into the combustion chamber, and a nozzle valve element positioned in the nozzle cavity adjacent the injector orifice. The nozzle valve element is movable between an open position in which fuel flows through the injector orifice into the combustion chamber and a closed position in which fuel flow through the injector orifice is blocked. A piezoelectric actuator including a stack of piezoelectric elements is movable to expand in a first direction and movable to contract in a second direction opposite the first direction. A hydraulic link assembly positioned within the nozzle cavity and including a hydraulic link housing, a hydraulic link plunger slidably mounted in the hydraulic link housing and operably connected to the piezoelectric actuator, and a hydraulic link operatively connecting the hydraulic link plunger and the nozzle valve element. A hydraulic link refill valve is provided to permit fuel flow into the hydraulic link chamber while preventing fuel flow from the hydraulic link chamber. An actuator power source operates to increase voltage to the piezoelectric actuator to cause the nozzle valve element to move into the open position in response to movement of the stack of piezoelectric elements in the first direction and for decreasing voltage to the piezoelectric actuator to cause the nozzle valve element to move into the closed position in response to movement of the stack of piezoelectric elements in the second direction. The opening and closing of the nozzle valve element defines an injection pulse and the hydraulic link refill valve is movable into an open position to refill the hydraulic link chamber when the voltage reaches a predetermined lower level. The actuator power source is further operable for varying the voltage to cause multiple injection pulses and for selectively maintaining the voltage above the predetermined lower level between injection pulses to maintain the refill valve in a closed position to prevent refilling of the hydraulic link chamber.

DETAILED DESCRIPTION OF THE INVENTION

Piezoelectric devices are capable of extremely fast and reliable valve response times. As a result, they offer greater control over fuel delivery, because they can be used to inject required amounts of fuel in a short time frame. The time frame for injecting fuel can be shortened by injecting the fuel at higher injection pressures. For instance, applicant has implemented extra high pressure injection systems where the pressures can reach 2400 bar. Such high injection pressures create smaller fuel droplets and higher injection velocity to promote more complete burning of the fuel, which maximizes power and increases fuel economy. In addition, pollution is minimized because the high thermal efficiencies result in low emissions of hydrocarbons (HC) and carbon monoxide (CO). By injecting required amounts of fuel in a shorter time frame, a high pressure system can accommodate multiple injection events during each combustion cycle. As a result, the engine control software can optimize combustion for particular conditions.

Applicant has recognized that the use of very high injection pressures, however, requires piezoelectric actuators of conventional fuel injectors to operate with correspondingly high force levels. In general, piezoelectric actuators must act against the high pressure fuel in the fuel injector to move the nozzle valve into an open position causing the injection of fuel. For instance, in one type of fuel injector design, a control chamber filled with high pressure fuel is employed to bias the nozzle valve in the closed position against the force of a spring, and the piezoelectric actuator opens a control valve to expose the control chamber to a low pressure drain. When the fuel drains from the control chamber, the pressure in the control chamber drops and is no longer able to keep the nozzle valve in the closed position. In order to open the control valve, the piezoelectric actuator must act against the high pressure in the control chamber. Thus, piezoelectric actuators in such fuel injectors must provide large forces due to the high pressure which exists in the fuel injector. Accordingly, the design of conventional piezoelectric actuators is dependent on the injector pressures. High pressure injection fuel injectors are required to use larger piezoelectric actuators to supply the necessary forces. Moreover, more power is required to operate conventional piezoelectric actuators with high injection pressures.

Figure 1:
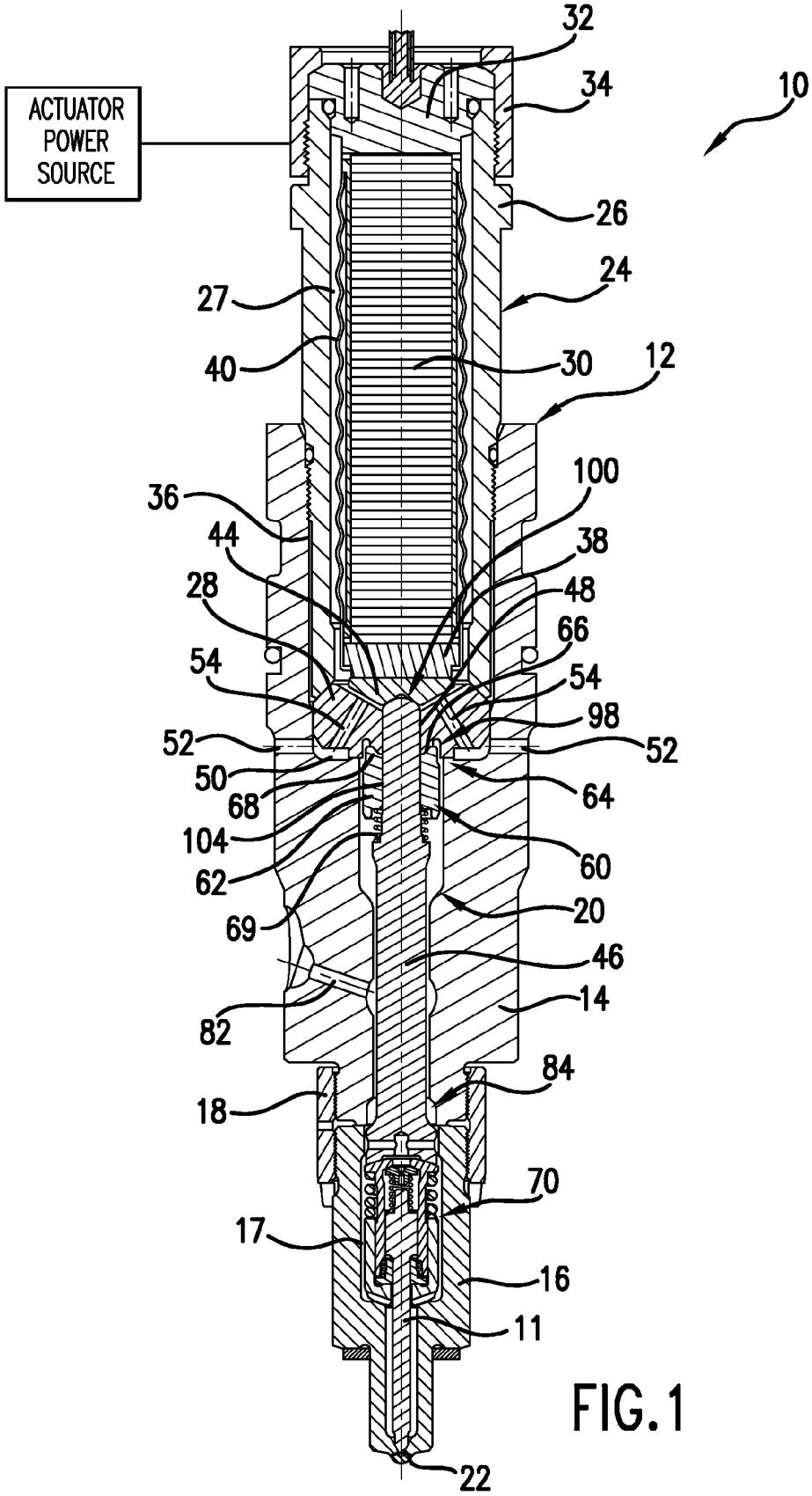
FIG. 1 is a cross-sectional view of a closed nozzle injector according to an exemplary disclosed embodiment.
Figure 2:
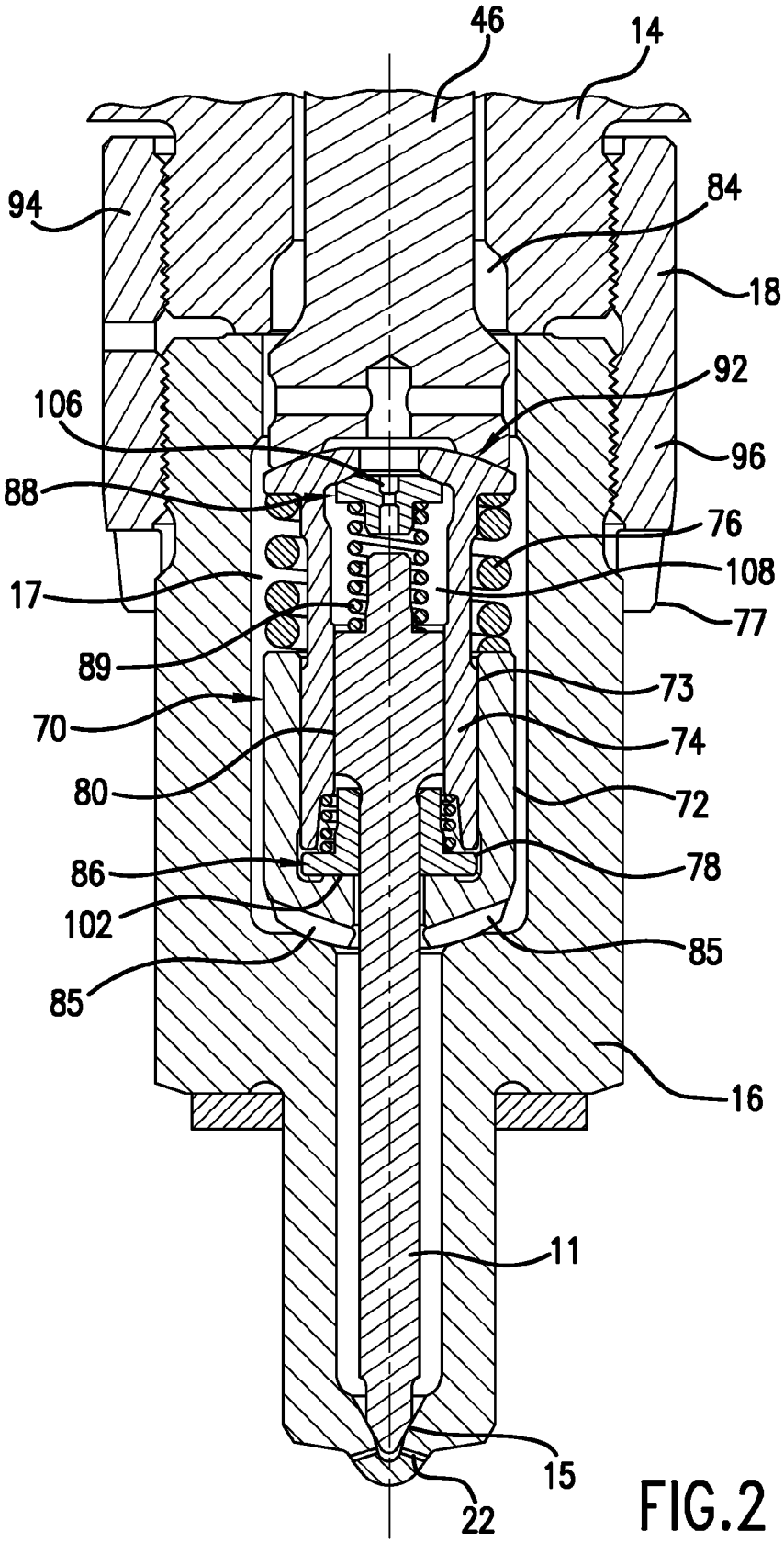
FIG. 2 is a an enlarged view of the lower portion of the injector of FIG. 1 showing the hydraulic link assembly.

FIGS. 1 and 2 illustrate a piezoelectric actuated fuel injector 1 according to an exemplary embodiment of the present invention designed to overcome one or more shortcomings of conventional injectors, including the shortcomings noted above and/or offer advantages noted herein below. Accordingly, FIGS. 1 and 2 show a piezoelectric actuated fuel injector 10 generally including an injector body 12 comprising a barrel 14, a nozzle housing 16 containing a nozzle cavity 17, a retainer 18 for connecting barrel 14 and nozzle housing 16, an injector cavity 20, and one or more injector orifices 22 for discharging fuel from injector cavity 20 to the combustion chamber. A nozzle, or needle, valve element 11 is mounted for reciprocal movement in nozzle cavity 11 between an open position in which fuel flows through injector orifices 15 into the combustion chamber and a closed position in which fuel flow through the injector orifices 15 is blocked. Injector 10 also includes a piezoelectric actuator assembly 24 including an upper actuator housing 26 and a lower actuator housing 28 positioned in an actuator cavity 36 formed in barrel 14. Actuator assembly 24 also includes, a stack of piezoelectric elements 30 positioned in a bore 27 formed in upper actuator housing 26, and an actuator cover 32 sealing the outer end of bore 27. An actuator cover retainer 34 threads onto upper actuator housing 26 to secure actuator cover 32 in position thereby securing the outer end of the stack of piezoelectric elements 30 in a fixed position. Actuator cavity 36 is a low pressure environment of piezoelectric actuated fuel injector 10 relative to the high pressure environment below lower actuator housing 28.

A bottom support 38 is positioned on the inner end of the stack of piezoelectric elements 30. A corrugated tubular housing 40 is attached to actuator cover 32 at one end and to bottom support 38 at an opposite end. Corrugated tubular housing 40 provides a preload to the stack to ensure the stack is always in compression thereby acting as a preload spring with a relatively low spring rate. This preload ensures the stack 30 is never in tension thereby avoiding fractures that can lead to actuator failures. Corrugated tubular housing 40 is sealed to block fluid from entering the housing and contacting the ceramic stack 30 thereby preventing detrimental effects fluids may have on actuator reliability.

An actuator link 44 is provided for abutment against bottom support 40 on one surface and an actuator plunger 46 on an opposite side. Actuator plunger 46 is positioned in injector cavity 20 and includes an outer end extending through a bore 48 formed in lower actuator housing 28 for abutment against the inner end of actuator link 44. In the exemplary embodiment, actuator link 44 includes a concave semispherical recess for receiving an outer semispherical end of actuator plunger 46 to keep the forces centered while allowing misalignment due to manufacturing and assembly tolerance. Thus actuator link 44 is used to transmit the actuating load to the actuator plunger 46 and to keep the load centered and distributed evenly across the stack of piezoelectric elements 30. The innermost end of lower actuator housing 28 sealingly engages barrel 14 and forms a fuel drain cavity 50 from which leakage fuel is drained to a low pressure drain via outlet ports 52. The diameter of actuator plunger 46 is sized and configured to provide a close, or match, fit relation to bore 48 in order to minimize any fuel leakage while permitting sliding movement of plunger 46. Any fuel leakage through the match fit clearance is delivered to fuel drain cavity 50 via drain passages 54.

A leakage control feature 60 includes a plunger sleeve 62 positioned around actuator plunger 46 to form a partial fluid seal between an inner surface of plunger sleeve 62 and an opposing outer surface of actuator plunger 46. A sleeve alignment feature 64 includes a frusto-conical surface 66 formed on lower actuator housing 28 and a semi-spherical surface 68 formed on plunger sleeve 62 and positioned to contact frusto-conical surface 66. Plunger sleeve 62 is biased into engagement with frusto-conical surface 66 by a bias spring 69 to create a fluid seal while permitting alignment of the sleeve 62 on plunger 46. The radially outward facing orientation of frusto-conical surface 66 also prevents the opposing portion of sleeve 62 from excessive contraction inwardly due to large pressure forces on the outer radial surface of sleeve 62 relative to low pressure in the fluid seal gap between sleeve 62 and plunger 46, thereby preventing binding of sleeve 62 on plunger 62.

Injector plunger 46 extends through barrel 14 and includes an inner end positioned in abutment against a hydraulic link assembly 70 positioned in nozzle housing 16. Preferably, hydraulic link assembly 70 is positioned entirely within a nozzle cavity 17 formed in nozzle housing 16. In this regard, preferably, nozzle housing 16 is a one-piece housing having nozzle seat 15 formed thereon. The hydraulic link assembly 70 includes a hydraulic link housing 72 having an inner bore 73, a hydraulic link plunger 74 positioned for relative slidable movement in inner bore 73 between hydraulic link housing 72 and hydraulic link plunger 74, a hydraulic link return spring 76, and a hydraulic link or volume 78 disposed within inner bore 73. An outer portion of needle valve element 11 is positioned for relative axial slidable movement within a central bore 80 formed in hydraulic link plunger 74 which is positioned for relative axial slidable movement within hydraulic link housing 72. Hydraulic link assembly 70 functions to convert the downward motion of piezoelectric elements 30 to an upward motion of needle valve element 11, as well as to amplify the motion of piezoelectric elements 30 to lift needle valve element 11 by an appropriate amount. The injector is direct acting in that it directly uses the force of the piezoelectric actuator 4 to apply a moving force to needle valve 3 and does not require an intermediate pressure or force loss, such as depressurizing a pressurized control volume by creating a low pressure drain flow from a control volume. The hydraulic link housing 72, hydraulic link plunger 74, and the outer end of needle valve element 11 are assembled in a telescoping, interfitting and overlapping relationship within nozzle cavity 17 of the nozzle housing 16. A fuel inlet 82 is configured to supply fuel to fuel supply cavity 84 and nozzle cavity 17. Delivery passages 85 formed in hydraulic link housing 72 permit flow throughout cavity 17. The fuel supply pressure may be within a pressure range of approximately 350-2700 bar.

An upper surface of the hydraulic link plunger 74 is in abutment with an inner end of the actuator plunger 46 disposed within the nozzle cavity 17. An inner end of hydraulic return spring 76 rests atop one end of hydraulic link housing 72. In the disclosed embodiment, the outer end of spring 76 abuts a flanged surface of hydraulic link plunger 74 to bias the flanged surface away from the end of hydraulic link housing 72. A refill valve 86, and a snubber valve 88 are also provided in a similar manner to the fuel injector disclosed in U.S. patent application Ser. No. 12/466,026 filed May 14, 2009 entitled "Piezoelectric Direct Acting Fuel Injector with Hydraulic Link". Except for the new or different features described herein, exemplary embodiments of the injector described herein generally operates like the fuel injector described in U.S. patent application Ser. No. 12/466,026 filed May 14, 2009 entitled "Piezoelectric Direct Acting Fuel Injector with Hydraulic Link", the entire contents of which is hereby incorporated by reference.

A. Needle Closing Velocity:

For optimum engine emissions, it is desirable that the needle valve element have a fast closing velocity. The closing velocity is commonly limited by the stress in the nozzle seat 15 during needle impact. Some conventional injectors have a relatively large mass in the needle element and associated moving parts, thus the closing velocity must be limited to provide an acceptable nozzle stress during needle impact. A method is needed to reduce the needle and moving part mass thus maximizing needle closing velocity.

Exemplary embodiments consistent with the claimed invention increase needle closing velocity due to the reduction of needle impact force resulting from the small mass of the needle valve element 11 and the needle spring 89. The small mass is a direct result of the hydraulic link assembly 70 being entirely located inside the nozzle housing 2 in close proximity to injector orifices 22.

B. Needle Tip Alignment & Spray Hole Alignment:

In fuel injectors it is important that the needle tip be maintained concentric to the nozzle seat when the needle is lifted to: 1) provide even fuel distribution among each injector orifice/spray hole for optimum fuel combustion and to minimize cavitation and 2) minimize the wear between the needle tip and the nozzle seat which would occur if the needle is not centered and has to slide along the nozzle seat when it is opening and closing. In many conventional fuel injectors, the needle tip alignment is achieved by providing a bore diameter in the nozzle or adjacent housing that guides the closely fitted needle valve element. This method is effective to a limited amount, but the nozzle or housing bore containing the needle valve element expands in size due to the high fuel pressure in the bore and the very low pressure on the outside of the nozzle or housing thus allowing additional needle tip eccentricity. There are some conventional injector applications that require the injector nozzle spray holes to be aligned with respect to the engine cylinder head, but this is difficult due to only having access to the smaller lower diameter region of the nozzle which has a relatively thin wall.

Embodiments consistent with the claimed invention improve the needle tip alignment to the nozzle seat 15 while also permitting easy alignment of the injector spray holes 22 with respect to the engine cylinder head. The exemplary embodiments provide the following features to achieve improved needle tip alignment:

- The hydraulic link assembly 70 is located inside nozzle cavity 17.
- The nozzle housing 16 is attached to the injector body 12 using a thread on each part and a threaded nozzle retainer 18 engaging the thread on each part to provide a larger cavity in the nozzle for hydraulic link assembly 70.
- This arrangement also provides a means for spray hole angular alignment when required (i.e. nozzle orientation round injector axis).
- The hydraulic link assembly 70 uses a "sphere on cone" joint 90 between the hydraulic link housing 72 and nozzle housing 16 to accurately position the upper end of the needle valve element 11, and the needle spring 89 forces the valve element 11 tip into the nozzle seat to accurately position the lower tip of the valve element 11.
- The hydraulic link plunger 74 is joined with the actuator plunger 46 using a "sphere on cone" joint 92 which allows the actuator plunger 46 to tilt as required while the hydraulic link assembly 70 remains aligned with the nozzle seat 15.

Specifically, at injector assembly, the nozzle housing 16 is attached to the barrel 14 using the threaded nozzle retainer 18. The design of these parts provides room for the larger cavity 17 in the nozzle housing 16 for the hydraulic link assembly 70 as well as provides a means for spray hole angular alignment when required (i.e. nozzle orientation around the injector axis) by loosening the retainer rotating the nozzle housing to the desired angular orientation and retightening the retainer. Many existing injector designs must use a smaller nozzle housing diameter due to the use of a nozzle retainer that inwardly toward the injector spray holes to surround the lower portion of the nozzle housing with the retainer wall leaving inadequate room for a hydraulic link assembly. Some conventional injector applications include an injector mounting bore, formed in a cylinder head, which is limited in size. Prior injectors using a retainer extending inwardly over the wider diameter section of the nozzle housing, requires the nozzle housing to be smaller in diameter, thereby requiring the nozzle cavity to be smaller. Such prior designs would preclude the positioning of the hydraulic link assembly in the nozzle cavity due to a lack of sufficient space, especially lateral width dimension (diameter). By using a short retainer 76 with distal end 77 that terminates at an outer location positioned within an outer one-third of the axial length of the nozzle housing 16, the nozzle housing 16 can be made larger to fit the mounting bore and thus the nozzle cavity 17 can be larger to accommodate the hydraulic link assembly 70. By positioning the hydraulic link assembly 70 in the nozzle cavity 44, between the inner end of the barrel 14 and the injector orifices 22, close to the injector orifices 22, the needle valve element 11 can be shortened (formed with a limited axial length) thereby minimizing the moving mass and thus limiting the impact force upon closing. Also a shorter needle valve element 11 is more responsive to changes in forces acting on the valve element 11, at least in part due to a reduction in the inherent stretching of the valve element 11 which occurs when hydraulic forces are applied to the valve element to overcome closing biasing forces to move the valve element toward an open position.

At assembly the nozzle retainer 18 and nozzle housing 16 are first assembled "hand tight" to the barrel 14. Holding the barrel 14 stationary, the nozzle housing 16 is backed out to the proper spray hole alignment position. Holding these two parts stationary, the nozzle retainer 18 is then tightened. Retainer 18 includes a first connector portion 94 including, for example, internal threads, for engaging complementary, for example, external threads, formed on barrel 14, and a second connector portion 96 including, for example, internal threads, for engaging complementary, for example, external threads formed on nozzle housing 16. Appropriate wrenching and/or alignment features may be included on the parts as required (e.g. flats, slots, tangs, or etc.). One embodiment uses a "turnbuckle" type design where the nozzle housing 16 has a left hand thread and the injector barrel 14 has a right hand thread (or vice versa). Another embodiment uses a "differential thread pitch" type design where the nozzle housing 16 and the injector barrel 14 both have right hand threads (or both left hand threads) with one part having a larger thread pitch than the other part.

The hydraulic link assembly 70 uses a "sphere on cone" nozzle joint 90 to position it accurately in the nozzle housing 16 which provides good alignment of the upper end of the needle valve element 11 with the nozzle seat 15. The hydraulic link, or plunger, return spring 76 applies a load to the hydraulic link housing 72 to ensure proper seating. Also the needle spring 89 forces the needle valve element 11 into the nozzle seat 15 ensuring that the lower tip of the needle valve element 11 is aligned. The hydraulic link plunger 74 in the hydraulic link assembly 70 is mated with the actuator plunger 46 using a "sphere on cone" plunger joint 92. Also the top end of the actuator plunger 46 uses a "sphere on cone" sleeve joint 98 and a "spherical" adapter joint 100. These three spherical interfaces allow the actuator plunger 46 to tilt as required to accommodate normal manufacturing tolerances, without binding, while the hydraulic link assembly 11 remains aligned with the nozzle seat 15. FIG. 2 shows that the nozzle joint 90 and the plunger joint 92 have the centers of the two spherical surfaces located in close proximity which along with joint friction prevents the system linkage from buckling during operation.

During injector operation, when the needle valve element 11 lifts during injector operation, element 11 maintains its alignment with the nozzle seat 15. To begin an injection pulse, the piezoelectric elements 30 expands which moves the hydraulic link plunger 74 down via the actuator link 44 and actuator plunger 46. This increases the pressure in the hydraulic link 78 in order to lift the needle valve element 11. This force along with the plunger return spring 76 force results in the nozzle joint 90 being locked in position before and during needle lift as well as at needle closing thus maintaining needle alignment. When lifted, the actual eccentricity of the needle valve element 11 tip with respect to the nozzle seat 15 is limited by the very small match fit clearances in the hydraulic link assembly 70.

C. Hydraulic Link Refill Valve Control:

The hydraulic link shown in U.S. patent application Ser. No. 12/466,026 filed May 14, 2009 entitled "Piezoelectric Direct Acting Fuel Injector with Hydraulic Link", contains a refill valve which provides the means for the hydraulic link volume to refill with fuel after an injection pulse. This refilling is necessary as some of the fuel in the hydraulic link is leaked out during an injection cycle. It is desirable for the injector to provide multiple injection pulses to the engine combustion chamber for each injection event/engine firing cycle. The minimum time between these multiple injection pulses is limited by the time it takes for the refill valve to open and then close before the next injection pulse/cycle. Additional potentially undesirable injection timing variability can result as well when the refill valve opens and closes between each injection pulse.

Exemplary embodiments consistent with the claimed invention provides controllable refill to allow hydraulic link chamber refill only when commanded. If the refill valve 86 is held closed between two or more injection pulses, then the pulses can be closer together which in some cases is very desirable for optimum fuel combustion as well as to reduce injection timing variability. The refill valve 86 could be commanded by an engine electronic control module or unit to refill when necessary to maintain the needle lift capability for the next injection pulse, e.g. after all or part of the multi-pulses of a combustion event.

Within the hydraulic link assembly 70, the refill valve 86 opens only when the hydraulic link volume 78 pressure is sufficiently lower than the fuel supply cavity/nozzle cavity pressure which normally happens after each injection pulse. In this present invention, the refill valve 86 can be held closed between injection pulses by commanding the appropriate lower limit of the piezoelectric actuator voltage after the injection pulse. The voltage is not allowed to go to zero after the injection pulse but is held to a voltage high enough to maintain the appropriate hydraulic link volume pressure above the fuel supply/nozzle cavity pressure but low enough to be below the pressure required to open the needle valve element 11. To allow the hydraulic link volume 78 to refill with fuel after an injection pulse, the piezoelectric actuator voltage is allowed to go to zero after the injection pulse. This allows the pressure in the hydraulic link volume 78 to be sufficiently lower than the cavity pressure to allow the refill valve 86 to open.

More specifically, fuel injector 10 of the present invention includes a hydraulic link refill valve 86 providing a passage with a relatively large flow area for refilling hydraulic link chamber or volume 78 very quickly between injection pulses or events while minimizing leakage flow out of hydraulic link chamber 78 during injection. In one disclosed embodiment, hydraulic link refill valve 86 consists of annular disc (or similar configuration) which provides a one-way seal with a suitable valve seat 102 in the mating part to form a check valve arrangement. Hydraulic link refill valve 86 can be spring-loaded in either direction if required by specific operating conditions.

In operation, when the pressure in hydraulic link chamber 78 is below the pressure in the fuel supply cavity/nozzle cavity, the refill valve 86 becomes unseated to allow fuel flow through the flow area to refill hydraulic link chamber 78 (e.g., between injection pulses). When the pressure in hydraulic link chamber 78 becomes greater than the pressure in the nozzle cavity, pressurized fuel from hydraulic link chamber 78 urges the refill valve 86 towards the its valve seat 102 until valve 86 becomes seated to close off the passage between the valve and the seat (e.g., when injection begins). The passage remains closed as long as the pressure in hydraulic link chamber 78 is greater than the supply pressure.

Figure 6A:
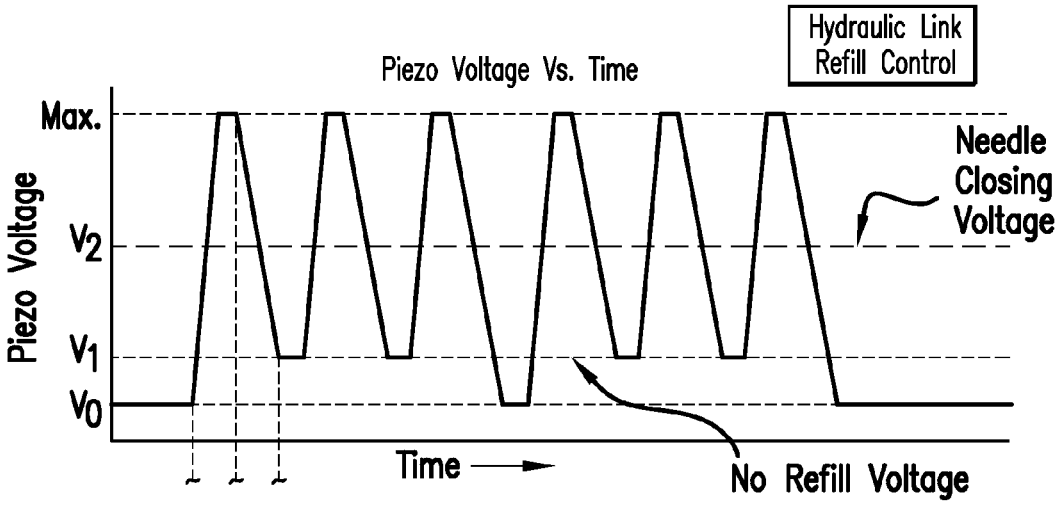
FIGS. 6*a*-6*c* provide graphical illustrations showing piezo-voltage, fuel pressure, and needle lift over the time period of an injection event with multiple injection pulses.
Figure 6B:
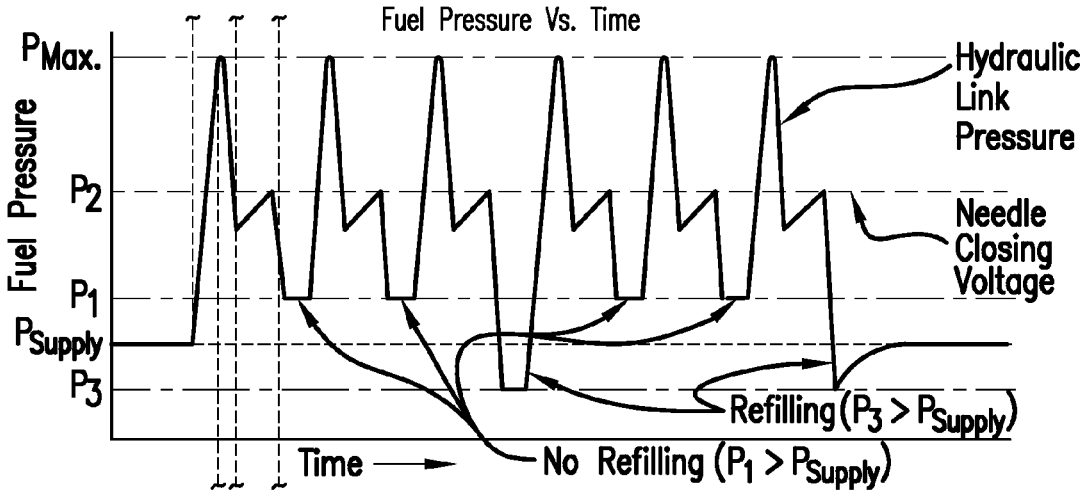
Figure 6C:
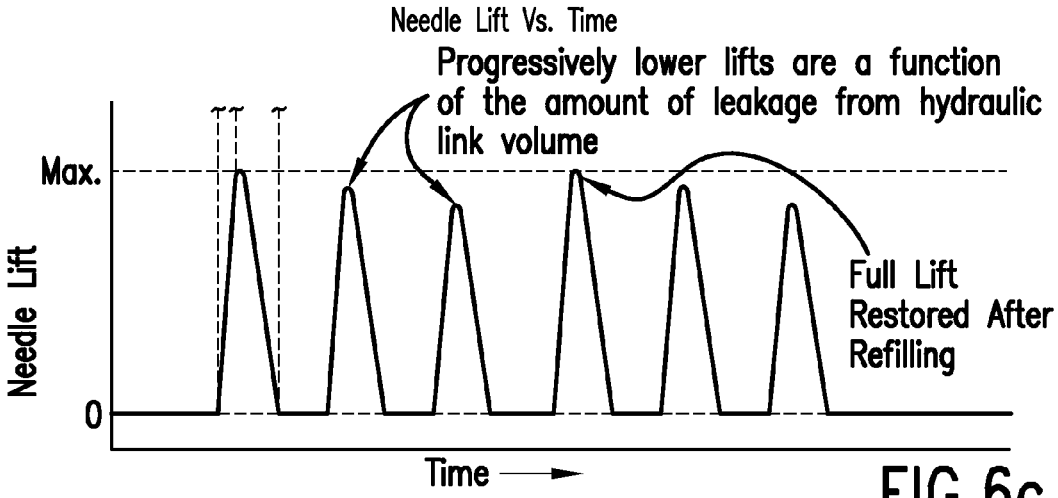

Importantly, referring to FIG. 2 and the graphs of FIGS. 6*a*-6*c*, the present invention also provides a method that allows the refill valve 86 to be controllable so as to allow it to refill only when commanded. Within the hydraulic link assembly 70, refill valve 86 opens only when the pressure in hydraulic link volume 78 is sufficiently lower than the fuel supply cavity/nozzle cavity 84/17 pressure which normally happens after each injection pulse. The refill valve 86 can be held closed between injection pulses by commanding the appropriate lower limit of the voltage of piezoelectric actuator 24 after the injection pulse. The voltage is not allowed to go to zero after the injection pulse but is held to a voltage high enough to maintain the appropriate pressure in hydraulic link volume 78 above the pressure in fuel supply/nozzle cavity 84/17 but low enough to be below the pressure required to open the needle valve element 11. This control method allows the injection pulses to be closer together, which in some cases is very desirable for optimum fuel combustion as well as to reduce injection timing variability.

To allow the hydraulic link volume 78 to refill with fuel after an injection pulse, the voltage of piezoelectric actuator assembly 24 is allowed to go to zero after the injection pulse. This allows the pressure in hydraulic link volume 78 to be sufficiently lower than the pressure in fuel supply/nozzle cavity 84/17 to allow the refill valve 86 to open. This refilling ensures that the needle valve element lift capability can be maintained for the next injection pulse after all or part of the multi-pulses of a combustion event.

D. Fuel Leakage Past Matched Fit Actuator Plunger Diameter:

It is desirable to minimize the high pressure fuel leakage to drain as this minimizes energy loss as well as avoids excessive heating of the injector components and the drain fuel returning to the fuel tank. Some conventional injectors use one or more close fitting matched fits between a plunger and its associated housing to minimize high pressure leakage while still allowing motion to be transmitted via the plunger. However, this same housing also provides a highly loaded face seal which can result in distortion of the matched fit bore making it necessary to use a larger clearance in the match fit to avoid plunger pinching due to bore distortion. This larger clearance results in more leakage.

Exemplary embodiments consistent with the claimed invention prevent housing distortion from affecting the match fit plunger clearance while maintaining a "leakage control feature". This invention provides a seal limiting the amount of high pressure fuel leakage to drain by the use of a match fit between the plunger sleeve 62 and the actuator plunger 46. The plunger sleeve 62 also seals against the lower actuator housing 28 using an appropriate seal joint. A "sphere on cone" joint 98 can be used to allow the actuator plunger 46 to tilt as required to accommodate normal manufacturing tolerances. The outside of the sleeve 62 is exposed to the pressure in fuel supply cavity 84 resulting in the sleeve bore contracting slightly as the supply pressure increases. The appropriate match fit clearance is provided to avoid plunger pinching. This clearance can be tapered to match the amount of bore contraction along the axis to further reduce leakage.

More specifically, exemplary embodiments provide a plunger seal annulus 104 which limits the amount of leakage of fuel from the fuel supply cavity 84 to the fuel drain cavity 50 by the use of a match fit between the plunger sleeve 62 and the actuator plunger 46. The plunger sleeve 62 also seals against the lower actuator housing 28 using the sphere on cone type sleeve joint 98. This joint also allows the actuator plunger 46 to tilt as required to accommodate normal manufacturing tolerances.

The outside of the plunger sleeve 62 is exposed to the pressure in fuel supply cavity 84 producing a radial hydraulic force tending to cause the plunger sleeve 62 bore to contract slightly as the pressure in fuel supply cavity 84 increases. In the sleeve joint 98, the internal conical surface is applied to the sleeve 62. This allows the axial hydraulic load on the sleeve to oppose the radial hydraulic force tending to contract the sleeve bore thus minimizing the amount of contraction of the bore of sleeve 62.

The appropriate match fit clearance in the plunger seal annulus 104 is provided to avoid pinching of the actuator plunger 46. This clearance can be tapered to match the amount of bore contraction along the axis to further reduce leakage.

E. Piezoelectric Actuator Housing and Preload Spring:

It is desirable for a piezoelectric actuator to have a housing or similar method to prevent unwanted fluids from reaching the ceramic stack due to detrimental effects on the actuator reliability. A preloading method is also necessary to ensure that the piezoelectric stack is always in compression and never in tension to avoid fractures that can lead to actuator failures. If a preload spring is used, then the lowest spring rate is desirable so as to obtain the highest available actuator energy output.

This invention provides a corrugated housing 40 to prevent the piezoelectric elements 30 from being exposed to drain fuel as well as to contain any oil used inside the actuator for improved heat transfer. It also acts as a preload spring for the stack of piezoelectric elements 30. The corrugated housing 40 is welded to the actuator cover 32. Corrugated housing 40 is then stretched to the appropriate load and welded to the bottom support 38. The corrugations in the corrugated housing 40 result in a relatively low spring rate to maximize the available piezoelectric actuator force.

As just previously mentioned, nozzle valve element 11 may be raised quickly to a desired lift position and have a tendency to oscillate around that position for a given period of time. A snubber valve 88 is positioned in the hydraulic link plunger 74 and includes a snubber valve orifice 106. The snubber valve 88 is biased into abutment against hydraulic link plunger 74 by the outer end of needle spring 16. Snubber valve 17 is employed for the purpose of quickly damping the oscillations of nozzle valve element 12 to achieve a more consistent fuel delivery. This is accomplished as the fuel trapped in the snubber chamber 40 exits via the snubber valve orifice 106, providing a restriction to the outward fuel flow and thus restricting the movement of nozzle valve element 11 in the raising direction. Snubber valve 88 also allows fuel to enter the snubber chamber 108 by moving the snubber valve 88 away from hydraulic link plunger 74 against the bias force of needle spring 89 causing little restriction to the movement of nozzle valve element 11 in the lowering direction.

Figure 3:
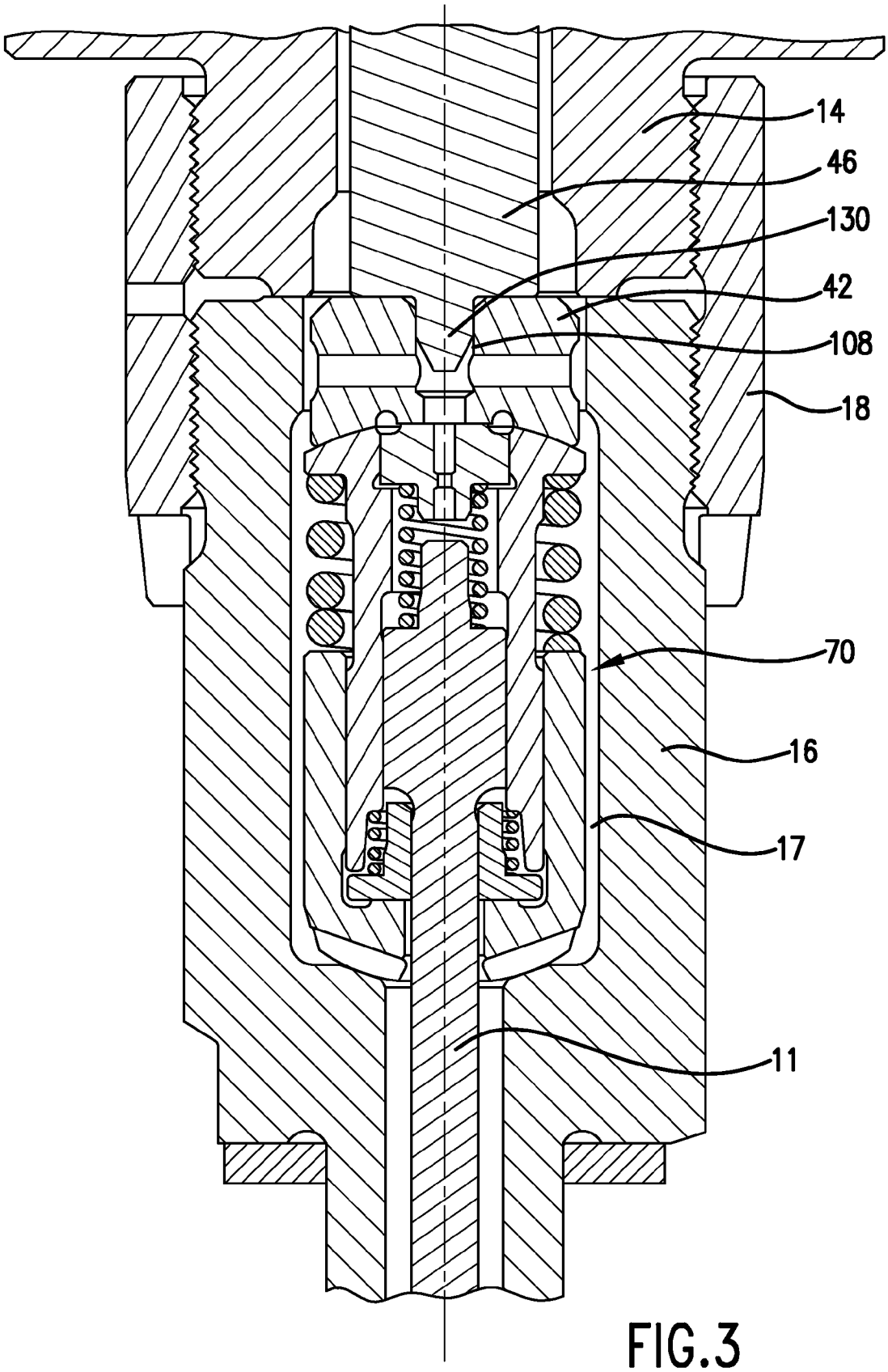
FIG. 3 is an enlarged view of the lower portion of another embodiment of a piezoelectric actuated fuel injector according to the prevent invention.

It should be noted that the inner end of the upper, or actuator, plunger 46 has a larger diameter thereby functioning as an intensification feature or intensifier. In another embodiment shown in FIG. 3, the inner end of actuator plunger 46 may include a single diameter to form a cylindrical shape while a separate intensifier component 42 may be positioned between the inner end of actuator plunger 46 and the outer end of hydraulic link plunger 74. The separate intensifier component 42 may include a center bore 108 for receiving a center post 130 of the actuator plunger 46 to connect the components together.

Figure 4:
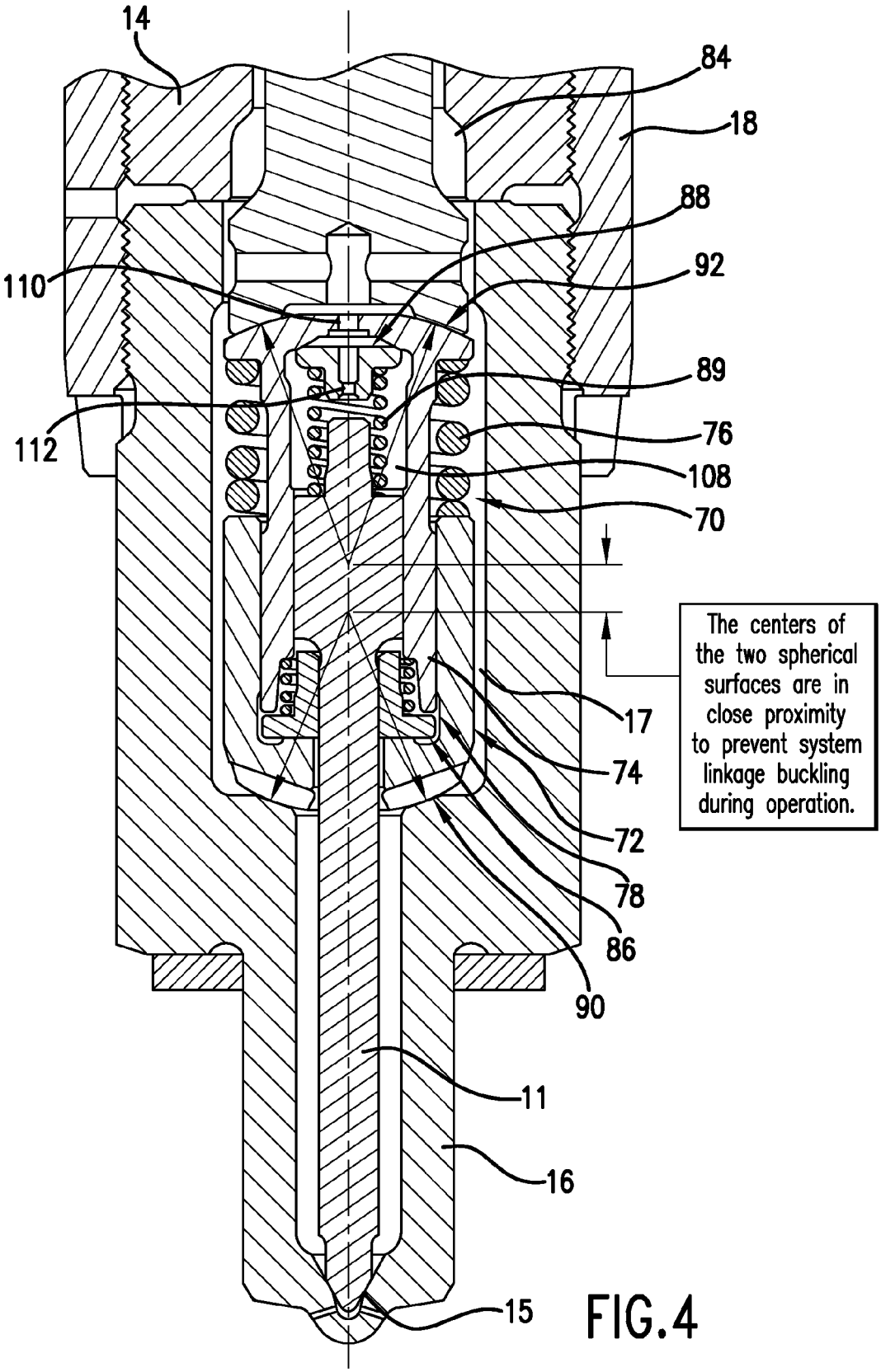
FIG. 4 is an enlarged view of the lower portion of another embodiment of a piezoelectric actuated fuel injector according to the present invention including a snubber valve having inlet and outlet orifices.

Referring to FIG. 4, in another embodiment, both a snubber inlet orifice 110 and a separate snubber outlet orifice 112 may be used to control flow in and out of the snubber chamber 108 positioned within hydraulic link plunger 74. The snubber inlet orifice 110 is formed in hydraulic link plunger 74 and provides the ability to reduce the needle closing impact velocity to avoid potential needle to seat beat-in issues. The minimum size of snubber inlet orifice 110 (i.e. the minimum impact velocity) is limited such that it must not excessively influence the needle opening delay and damping as it is in series with the snubber outlet orifice 112.

Figure 5:
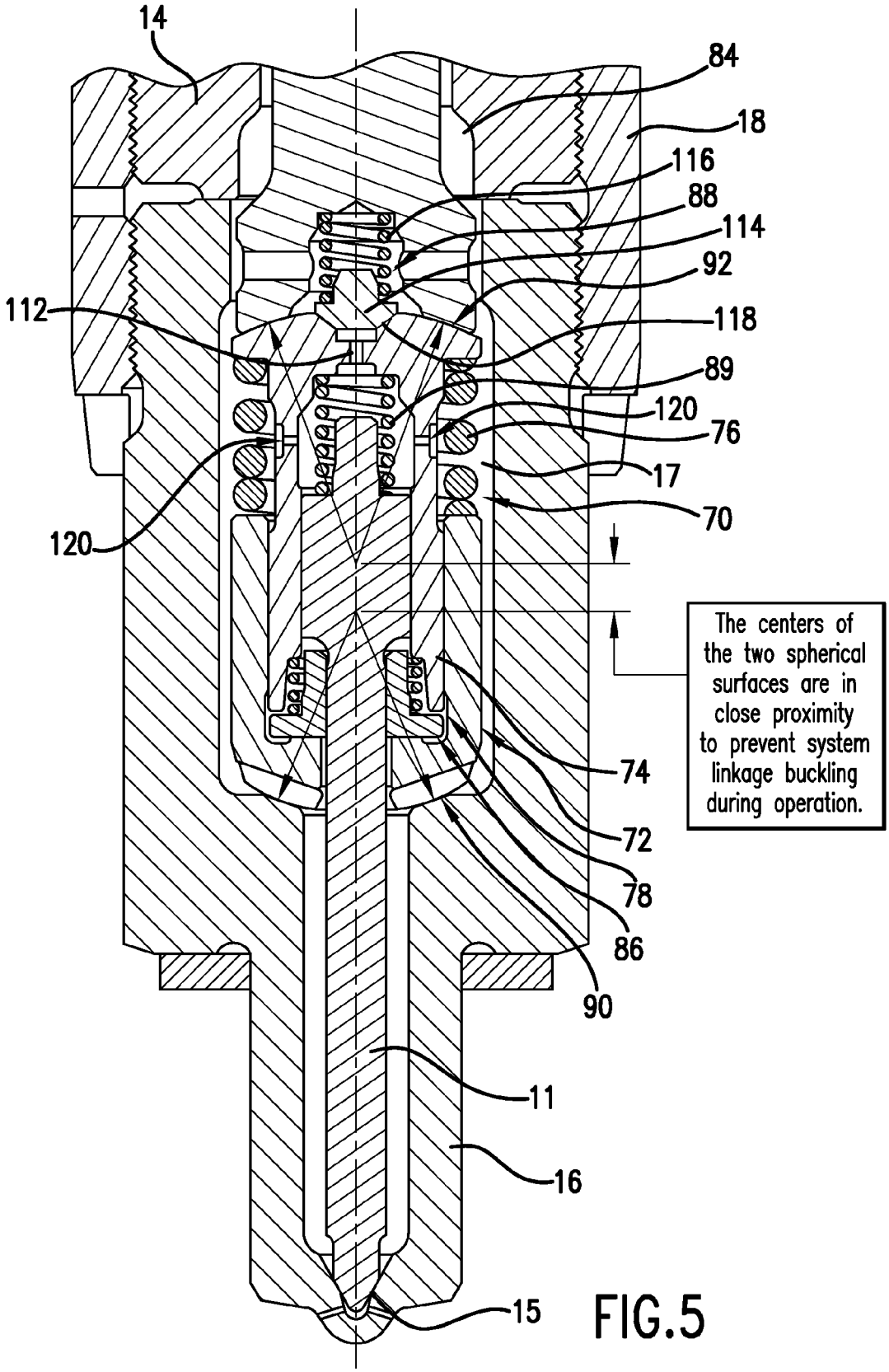
FIG. 5 is an enlarged view of the lower portion of another embodiment of a piezoelectric actuated fuel injector according to the present invention including a snubber valve positioned outside the outer plunger.

FIG. 5 shows an embodiment which permits more damping (i.e. more orifice restriction) during the needle valve element closing than during the needle valve element opening. This configuration provides independent control of the damping during needle opening and during needle closing. Thus the needle closing impact velocity can be decreased while not affecting the needle opening delay and damping. In this embodiment, snubber valve 88 includes a snubber valve element 114 positioned outside hydraulic link plunger 74 and biased inwardly by a spring 116 against a valve seat 118 formed on plunger 74. During needle valve element opening, the fluid flows out of the snubber chamber (damping chamber) 108 through snubber outlet orifice 112 as well as the two snubber inlet orifices 120 formed opposite one another in the annular wall of hydraulic link plunger 74, thereby connecting snubber chamber 108 to nozzle cavity 17. During needle closing, the fluid flows into the damping chamber only through the two snubber inlet orifices 120. In other embodiments, only one, or more than two snubber inlet orifices may be used. However, two or more orifices would balance the flow forces acting radially on the hydraulic link assembly.

The fuel injector of the present invention is capable of multiple fuel pulses per combustion event spaced at closer intervals (e.g. 7 or more) at high injection pressure to better meet future engine emissions requirements while using a minimum of expensive exhaust after-treatment devices. The lower needle mass, faster needle closing response, and improved needle to nozzle seat alignment helps to improve engine emissions and injector durability. This injector design principle can be applied to light duty, mid-range, heavy-duty, and larger engines, but the required energy from the actuator increases as the flow and/or pressure requirements increase. Hence, the fuel injector of the present invention may gain significant advantages over the prior art by seeking to minimize the necessary movement for lifting the needle valve element 11 off its valve seat to perform a fuel injection event within the quickest response time. To achieve such results, the exemplary embodiments provide a unique hydraulic link assembly 70 to connect the piezoelectric actuator 24 with the needle valve element 11 utilizing leakage control features, as described herein, to thereby provide a direct acting injector that is more controllable and faster acting while minimizing drain flow. An avoidance of any orifices in the fuel supply passages upstream of the nozzle valve element seat 15 is provided in order to maximize sac pressure (i.e., at sac chamber). The upper or actuator plunger 46 facilitates connection of piezoelectric actuator 24 to hydraulic link assembly 70. Hydraulic link assembly 70 directly acts to convert the downward motion of piezoelectric actuator 24 to an upward motion of needle valve element 11 (i.e., hydraulic link plunger 74 is pushed down by the stack of piezoelectric elements 30, and needle valve element 11 is pushed up by the resulting hydraulic link chamber 78 fuel pressure). Hydraulic link plunger diameters are selected to obtain the optimal motion amplification required for the desired movement of needle valve element 11. Hydraulic link chamber 78 is selectively refilled between injection events, and selectively refilled between injection pulses, as required, to allow the fuel injection components to return to original positions (for subsequent fuel injection events) even when thermal changes occur.

It will be apparent to those skilled in the art that various modifications and variations can be made in the disclosed apparatus and method without departing from the scope of the disclosure. Additionally, other embodiments of the apparatus and method will be apparent to those skilled in the art from consideration of the specification. It is intended that the specification and examples be considered as exemplary only, with a true scope of the disclosure being indicated by the following claims and their equivalents.

What is claimed is:

1. A piezoelectric-actuated fuel injector for injecting fuel into a combustion chamber of an internal combustion engine, comprising:

an injector body including a barrel, a nozzle housing having a nozzle cavity, a retainer connecting said barrel and said nozzle housing, and an injector orifice communicating with one end of said nozzle cavity to discharge fuel into the combustion chamber;

a nozzle valve element positioned in said nozzle cavity adjacent said injector orifice, said nozzle valve movable between an open position in which fuel flows through said injector orifice into the combustion chamber and a closed position in which fuel flow through said injector orifice is blocked;

a piezoelectric actuator including a stack of piezoelectric elements movable to expand in a first direction and movable to contract in a second direction opposite said first direction;

a hydraulic link assembly positioned within said nozzle cavity, said hydraulic link assembly including a hydraulic link housing having an inner bore, a hydraulic link plunger positioned to slidably move in said inner bore and operably connected to said piezoelectric actuator, and a hydraulic link operatively connecting said hydraulic link plunger and said nozzle valve element.

2. The fuel injector of claim 1, wherein said hydraulic link plunger includes a center bore, said nozzle valve element extending into said center bore of said hydraulic link plunger, wherein said hydraulic link plunger, said nozzle valve element, and said hydraulic link housing are positioned in overlapping relationship along a longitudinal extent of the injector body, said hydraulic link being positioned between said hydraulic link housing and said hydraulic link plunger.

3. The fuel injector of claim 2, wherein the hydraulic link is formed around said nozzle valve element and between one end of said hydraulic link plunger and said hydraulic link housing.

4. The fuel injector of claim 1, further including an actuator plunger operatively connecting said piezoelectric actuator to said hydraulic link plunger, and a leakage control feature including a plunger sleeve positioned around said actuator plunger to form a partial fluid seal between an inner surface of the plunger sleeve and an opposing outer surface of the actuator plunger.

5. The fuel injector of claim 4, further including an actuator housing having a center bore for receiving said actuator plunger, and a sleeve alignment feature including a frusto-conical surface formed on said actuator housing and a semi-spherical surface formed on said plunger sleeve and positioned to contact said frusto-conical surface.

6. The fuel injector of claim 1, further including an actuator plunger operatively connecting said piezoelectric actuator to said hydraulic link plunger, and a plunger alignment feature including a frusto-conical surface formed on said actuator plunger and a semi-spherical surface formed on said hydraulic link plunger and positioned to contact said frusto-conical surface of said actuator plunger.

7. The fuel injector of claim 6, wherein said plunger alignment feature is positioned in said nozzle cavity.

8. The fuel injector of claim 6, further including a hydraulic link housing alignment feature including a frusto-conical surface formed on said nozzle housing and a semi-spherical surface formed on said hydraulic link housing and positioned to contact said frusto-conical surface of said nozzle housing.

9. The fuel injector of claim 1, wherein said hydraulic link is positioned in a hydraulic link chamber, further including a hydraulic link refill valve operable to permit fuel flow into said hydraulic link chamber while preventing fuel flow from said hydraulic link chamber.

10. The fuel injector of claim 9, wherein said hydraulic link refill valve is positioned within said hydraulic link housing and includes a refill valve body mounted for slidable movement on said nozzle valve element and a valve seat formed on said hydraulic link housing.

11. The fuel injector of claim 9, further comprising an actuator power source means for increasing voltage to said piezoelectric actuator to cause said nozzle valve element to move into said open position in response to movement of said stack of piezoelectric elements in said first direction and for decreasing voltage to said piezoelectric actuator to cause said nozzle valve element to move into said closed position in response to movement of said stack of piezoelectric elements in said second direction, said opening and said closing of said nozzle valve element defining an injection pulse and said hydraulic link refill valve being movable into an open position to refill said hydraulic link chamber when said voltage reaches a predetermined lower level, said actuator power source means further operable for varying said voltage to cause multiple injection pulses and for selectively maintaining said voltage above said predetermined lower level between injection pulses to maintain said refill valve in a closed position to prevent refilling of said hydraulic link chamber.

12. The fuel injector of claim 1, further comprising a valve chamber formed in said hydraulic link plunger and a valve positioned in said valve chamber to restrict fuel flow out of said valve chamber to restrict movement of said nozzle valve element in the second direction.

13. The fuel injector of claim 1, wherein said injector body further includes a retainer including a first connector portion including internal threads for engaging complementary external threads formed on said barrel and a second connector portion including internal threads for engaging complementary external threads formed on said nozzle housing.

14. The fuel injector of claim 13, wherein said retainer includes an innermost distal end, said hydraulic link positioned along a longitudinal extent of said injector body between said inner distal end and said injector orifice.

15. A piezoelectric-actuated fuel injector for injecting fuel into a combustion chamber of an internal combustion engine, comprising:

an injector body including a nozzle housing having a nozzle cavity, and an injector orifice communicating with one end of said nozzle cavity to discharge fuel into the combustion chamber;

a nozzle valve element positioned in said nozzle cavity adjacent said injector orifice, said nozzle valve movable between an open position in which fuel flows through said injector orifice into the combustion chamber and a closed position in which fuel flow through said injector orifice is blocked;

a piezoelectric actuator including a stack of piezoelectric elements movable to expand in a first direction and movable to contract in a second direction opposite said first direction;

a hydraulic link assembly positioned within said nozzle cavity, said hydraulic link assembly including a hydraulic link housing, a hydraulic link plunger slidably mounted in said hydraulic link housing and operably connected to said piezoelectric actuator, and a hydraulic link operatively connecting said hydraulic link plunger and said nozzle valve element;

a hydraulic link refill valve operable to permit fuel flow into said hydraulic link chamber while preventing fuel flow from said hydraulic link chamber; and an actuator power source means for increasing voltage to said piezoelectric actuator to cause said nozzle valve element to move into said open position in response to movement of said stack of piezoelectric elements in said first direction and for decreasing voltage to said piezoelectric actuator to cause said nozzle valve element to move into said closed position in response to movement of said stack of piezoelectric elements in said second direction, said opening and said closing of said nozzle valve element defining an injection pulse and said hydraulic link refill valve being movable into an open position to refill said hydraulic link chamber when said voltage reaches a predetermined lower level, said actuator power source means further operable for varying said voltage to cause multiple injection pulses and for selectively maintaining said voltage above said predetermined lower level between injection pulses to maintain said refill valve in a closed position to prevent refilling of said hydraulic link chamber.

16. The fuel injector of claim 15, wherein said actuator power source means is further operable to selectively decrease said voltage below said predetermined lower level to cause said refill valve to move into said open position to cause refilling of said hydraulic link chamber.

17. The fuel injector of claim 15, wherein said hydraulic link refill valve is positioned within said hydraulic link housing.

18. The fuel injector of claim 15, wherein said hydraulic link refill valve includes a refill valve body mounted for slidable movement on said nozzle valve element and a valve seat formed on said hydraulic link housing.

19. The fuel injector of claim 15, wherein said hydraulic link plunger includes a center bore, said nozzle valve element extending into said center bore of said hydraulic link plunger, wherein said hydraulic link plunger, said nozzle valve element, and said hydraulic link housing are positioned in overlapping relationship along a longitudinal extent of the injector body, said hydraulic link being positioned between said hydraulic link housing and said hydraulic link plunger.

20. The fuel injector of claim 15, further comprising a valve chamber formed in said hydraulic link plunger and a valve positioned in said valve chamber to restrict fuel flow out of said valve chamber to restrict movement of said nozzle valve element in the second direction.

* * * * *